US009771838B2

(12) United States Patent
Kim

(10) Patent No.: US 9,771,838 B2
(45) Date of Patent: Sep. 26, 2017

(54) VARIABLE VALVE LIFT APPARATUS

(71) Applicant: HYUNDAI MOTOR COMPANY, Seoul (KR)

(72) Inventor: Sangyun Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 339 days.

(21) Appl. No.: 14/558,650

(22) Filed: Dec. 2, 2014

(65) Prior Publication Data

US 2016/0069225 A1 Mar. 10, 2016

(30) Foreign Application Priority Data

Sep. 5, 2014 (KR) ..... 10-2014-0119222

(51) Int. Cl.
*F01L 9/02* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 9/02* (2013.01)

(58) Field of Classification Search
CPC . F01L 1/3442; F01L 1/047; F01L 9/02; F01L 1/185; F01L 13/0005; F01L 13/0015; F01L 2105/00; F01L 2105/02; Y10T 74/20882
USPC ..... 123/90.12, 90.39
See application file for complete search history.

(56) References Cited

U.S. PATENT DOCUMENTS 6,755,167 B2 * 6/2004 Krieg ..... F01L 1/08 123/90.16
2009/0223473 A1 * 9/2009 Elnick ..... F01L 1/185 123/90.39
2014/0366826 A1 * 12/2014 Brune ..... F01L 1/2405 123/90.45

FOREIGN PATENT DOCUMENTS

JP 5-44410 B2 10/2012
KR 10-2009-0043283 A 5/2009

* cited by examiner

*Primary Examiner* — Jason Shanske
*Assistant Examiner* — Kelsey Stanek
(74) *Attorney, Agent, or Firm* — McDermott Will & Emery LLP

(57) ABSTRACT

A variable valve lift apparatus includes a lever body having a set length for a lever motion. One end of the lever body is connected with a hydraulic pressure supply portion and another end thereof is connected with the valve. A rotation shaft is disposed such that a width direction of the lever body is a length direction of the rotation shaft. A roller rotates around the rotation shaft. A high cam is disposed at the camshaft to rotate together with the camshaft and has a lobe shape for rolling-contact the roller to realize a high lift. A low cam is disposed at the camshaft to rotate together with the camshaft and has a lobe shape for rolling-contacting the roller to realize a low lift. The roller is disposed to slide along the length direction of the rotation shaft and selectively rolling-contact with the high cam or the low cam by sliding.

20 Claims, 7 Drawing Sheets

VARIABLE VALVE LIFT APPARATUS

CROSS-REFERENCE TO RELATED APPLICATION

This application claims the benefit of priority to Korean Patent Application No. 10-2014-0119222 filed in the Korean Intellectual Property Office on Sep. 5, 2014, the entire contents of which are incorporated herein by reference.

TECHNICAL FIELD

The present disclosure relates to a variable valve lift apparatus. More particularly, the present disclosure relates to a variable valve lift apparatus which can change a valve lift by selectively connecting with a high cam or a low cam.

BACKGROUND

An internal combustion engine generates power by burning fuel and air received in a combustion chamber. Herein, an intake valve is operated by drive of a camshaft, and air flows into the combustion chamber while the intake valve is open. In addition, an exhaust valve is operated by driving a camshaft, and air is exhausted from the combustion chamber while the exhaust valve is opened.

Optimal operations of the intake valve or the exhaust valve are determined according to a rotational speed of the engine. That is, lift and open/close timing of the valves are properly controlled according to the rotational speed of the engine. A variable valve lift (VVL) apparatus has been developed in which the valves are operated with various lifts according to the rotational speed of the engine for realizing the optimal operations of the valves according to the rotational speed of the engine. For example, there is a variable valve lift apparatus in which a plurality of cams for operating the valves at each different lift are provided to the camshaft, and the cam operating the valves is selected according to conditions.

When the plurality of cams are provided to the camshaft, however, the composition for selectively changing the cam to operate the intake valve or the exhaust valve may become complex, and interference between the elements of the composition may occur. If the plurality of cams are respectively and independently operated for preventing interference between the elements of the composition, an additional constituent element is required for each cam for operating the cam such that the cost may be increased.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide variable valve lift apparatus having advantages of providing a simple composition and preventing interference between constituent elements.

A variable valve lift apparatus according to an exemplary embodiment of the present inventive concept may selectively change a lift of a valve which is driven to perform intake or exhaust of an engine according to rotation of a camshaft with a high lift or a low lift. The variable valve lift apparatus may include a lever body formed to have a set length to make a lever motion according to the rotation of the camshaft, and one end thereof is connected with a hydraulic pressure supply portion and another end thereof is connected with the valve. A rotation shaft is disposed such that a width direction of the lever body is a length direction of the rotation shaft. A roller is disposed to rotate around the rotation shaft. A high cam is disposed at the camshaft to rotate together with the camshaft and to have a lobe shape for rolling-contacting with the roller to realize the high lift. A low cam is disposed at the camshaft to rotate together with the camshaft and to have a lobe shape for rolling-contacting with the roller to realize the low lift.

The roller may be disposed to slide along the length direction of the rotation shaft and selectively rolling-contact the high cam or the low cam by sliding.

A housing which has a cup shape that an inner side thereof is opened and an outer side thereof is closed may be formed at the roller. A shaft body is disposed inside of the housing and is thicker than both ends of the length direction of the rotation shaft may be formed at the rotation shaft, and both ends of the length direction of the rotation shaft may be disposed to respectively penetrate the closed outer side of the housing.

The variable valve lift apparatus may further include an elastic member supported by the lever body to push an exterior surface of the roller toward inside. A hydraulic pressure chamber may be formed between an interior surface of the close outer side of the housing and an exterior surface of the shaft body.

The roller may slide by a hydraulic pressure supplied from the hydraulic pressure supply portion to the hydraulic pressure chamber. The roller may be slid toward inside by the elastic member as the hydraulic pressure supplied from the hydraulic pressure supply portion to the hydraulic pressure chamber is released.

The lever body may form a connecting hole which receives the hydraulic to pressure from the hydraulic pressure supply portion. A body oil passage communicates with the connecting hole and extends toward the rotation shaft. The rotation shaft may form a shaft oil passage which communicates the body oil passage inside of the rotation shaft and a supply passage is disposed to be crossed with the shaft oil passage and communicates with the hydraulic pressure chamber.

The hydraulic pressure generated from the hydraulic pressure supply portion may sequentially pass through the connecting hole, the body oil passage, the shaft oil passage, and the supply passage to be supplied to the hydraulic pressure chamber.

The shaft oil passage may be formed with traversing the shaft body along the length direction of the rotation shaft. The supply passage may be formed to slant with respect to the length direction of the rotation shaft to be extended to the exterior surface of the shaft body and communicate with the hydraulic pressure chamber.

A stopper which functions as a blocker to limit sliding of the roller when the roller is slid toward inside by releasing hydraulic pressure supply may be formed to be protruded from an exterior circumference of the shaft body.

The roller may be slid toward outside to rolling-contact to the high cam and may be slid toward inside to rolling-contact to the low cam.

The roller may be comprised with two rollers, and the two rollers may be simultaneously slid toward outside or slid toward inside.

The high cam may be comprised with two high cams which are disposed at both sides of the low cam, and the two rollers may be slid toward outside to respectively rolling-contact to the high cams which are respectively disposed at the both sides of the low cam and are slid toward inside to rolling-contact to the low cam.

A variable valve lift apparatus according to an exemplary embodiment of the present inventive concept may include a lever body having a set length for a lever motion according to rotation of a camshaft and having a set width and a set thickness to form an interior space which is vertically penetrated thereto. A hydraulic pressure supply portion is mounted at one end of the lever body to supply hydraulic pressure to the lever body. A rotation shaft is disposed to traverse the interior space of the lever body. A roller is disposed in the interior space of the lever body and rotates around the rotation shaft and to slide along a length direction of the rotation shaft. A shaft body is formed to be thicker than both ends of the length direction of the rotation shaft at a middle portion in the length direction of the rotation shaft to contact to an interior circumference of the roller for guiding the roller which slides. A hydraulic pressure chamber is formed between an exterior surface of the shaft body and an exterior surface of the roller. An elastic member is disposed between an interior surface of the lever body surrounding the interior space and the exterior surface of the roller. A high cam selectively rolling-contacts with the roller and rotates together with the camshaft to make a lever motion of the lever body and has a lobe shape for realizing a high lift of a valve which is connected with the one end of the lever body. A low cam selectively rolling-contacts with the roller and rotates together with the camshaft to make a lever motion of the lever body, and has a lobe shape for realizing a low lift of a valve which is connected with the one end of the lever body.

The roller may be slid toward outside to rolling-contact with the high cam according to a hydraulic pressure is supplied from the hydraulic pressure supply portion to the hydraulic pressure chamber, and the roller may be slid toward inside by the elastic member to rolling-contact with the low cam according to the is hydraulic pressure of the hydraulic pressure chamber is released.

The variable valve lift apparatus may further include a connecting hole formed at the one end of the lever body to receive hydraulic pressure from the hydraulic pressure supply portion; a body oil passage formed in the lever body to be communicated with the connecting hole and be extended toward the rotation shaft. A shaft oil passage is formed in the rotation shaft to be communicated with the body oil passage. A supply passage is formed at the shaft body to be crossed with the shaft oil passage and to communicate with the hydraulic pressure chamber.

Hydraulic pressure generated from the hydraulic pressure supply portion may sequentially pass through the connecting hole, the body oil passage, the shaft oil passage, and the supply passage to be supplied to the hydraulic pressure chamber.

A hydraulic pressure supply hole which is communicated with the connecting hole may be formed at the hydraulic pressure supply portion such that hydraulic pressure generated from the hydraulic pressure supply portion is supplied to the lever body. The connecting hole may communicate with the hydraulic pressure supply hole when the roller is contacted to a base of the high cam or the low cam and the communication between the connecting hole and the hydraulic pressure supply hole may be closed when the roller contacts a lobe of the high cam or the low cam.

The supply passage may be formed to slant with respect to the length direction of the rotation shaft.

A base of the high cam may conform to a base of the low cam.

A stopper which protrudes from an exterior circumference of the shaft body may be formed to limit sliding of the roller when the roller slide toward inside.

The roller may be comprised with two rollers which simultaneously slide toward outside or slid toward inside.

The high cam may have two high cams which are disposed at both sides of the low cam such that the two rollers slide toward outside to respectively rolling-contact to the two high cams.

DETAILED DESCRIPTION

An exemplary embodiment of the present inventive concept will hereinafter be described in detail with reference to the accompanying drawings.

Figure 1:
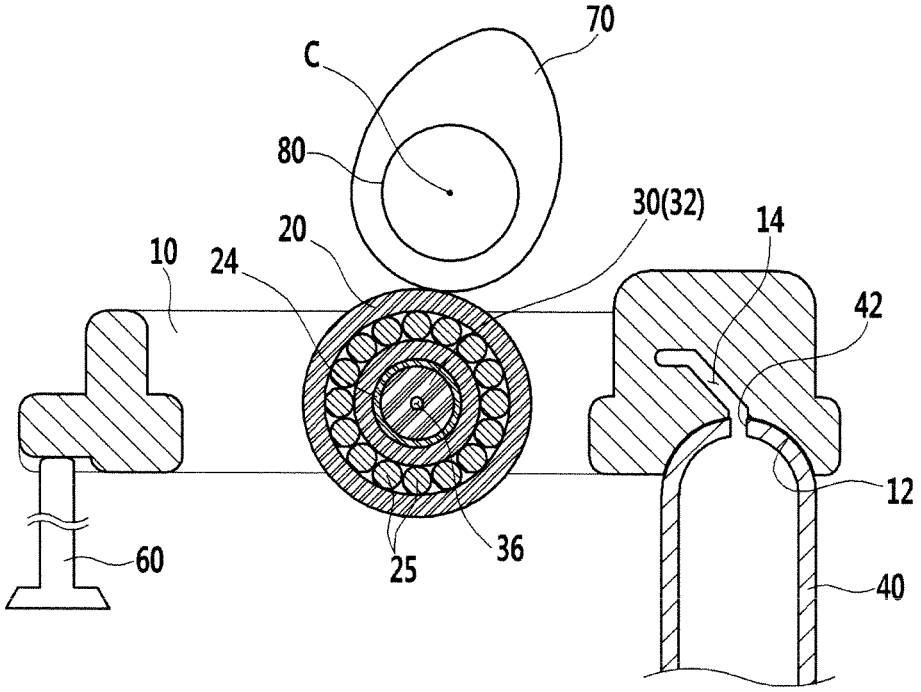
FIG. 1 is a schematic diagram of a variable valve lift apparatus according to an exemplary embodiment of the present inventive concept.

FIG. 1 is a schematic diagram of a variable valve lift apparatus according to an exemplary embodiment of the present inventive concept.

As shown in FIG. 1, a variable valve lift apparatus according to an exemplary embodiment of the present inventive concept includes a lever body 10, a roller 20, a rotation shaft 30, and a hydraulic pressure supply portion 40.

The lever body 10 makes a lever motion by receiving a torque of a camshaft 80 and operates so as to open/close a valve 60. In addition, a cam 70 is formed or disposed on the camshaft 80 to convert rotational motion of the camshaft 80 to lever motion of the lever body 10. Herein, the valve 60 is an intake valve or an exhaust valve for an engine.

The cam 70 is formed to have a general cam shape in which an outside circumference of a cross section of the cam 70 is formed to have an oval shape with one end projected more than the other end. In general, one end of the cam 70 is called as a lobe, and the other end of the cam 70 is call as a base.

The base of the cam 70 is a base circle of the cam 70 having an arc with a fixed radius within the outside circumference of the cam 70. Herein, the arc of the base is an arc having a rotational center C of the cam 70 as a circle center C of the arc. In addition, the cam lobe is a part of an external circumference of the cam 70 which pushes the roller 20 from when opening of the valve 60 starts to when closing of the valve 60 ends by rotation of the cam 70.

The lever body 10 has a seating groove 12 and a connecting hole 14. The seating groove 12 is a groove formed for seating the hydraulic pressure supply portion 40 thereon. In addition, the hydraulic pressure supply portion 40 is mounted to one end of the lever body 10 the lever body 10 on the state of being seated on the seating groove 12. Further, another end of the lever body 10 is connected with the valve 60 such that the valve 60 is opened or closed by the lever motion of the lever body 10.

A space which is penetrated along a vertical direction of the lever body 10 is formed inside of the lever body 10. That is, the lever body 10 has a set length to make the lever motion and has a set width and a set thickness to form the interior space of the lever body 10. A rotational center of the lever motion formed at the one end of the lever body 10 which is connected with the hydraulic pressure supply portion 40.

In description hereinafter, an exterior surface and an interior surface or outside and inside constituent elements which are provided to the lever body 10 mean a portion on the same side with outside and inside with respect to a width direction of the lever body 10.

The connecting hole 14 is a hole which is connected from the seating groove 12 to inside of the lever body 10.

The roller 20 is disposed in the interior space of the lever body 10 and is rotatably connected with the lever body 10. Further, the roller 20 is rolling-contacted with the cam 70 so as to convert rotational motion of the camshaft 80 to the lever motion of the lever body 10.

The rotation shaft 30 is a shaft formed in a cylindrical shape which is to be a rotational center of the roller 20. In addition, the rotation shaft 30 is disposed so as to penetrate the lever body 10 along a width direction of the lever body 10, the lever body 10 and the roller 20 are rotatably connected with each other by the rotation shaft 30. That is, the rotation shaft 30 is disposed to traverse the interior space of the lever body 10.

The roller 20 is formed in a hollow cylindrical shape, and a power transmission member 25 provided in the hollow of the roller 20. In addition, the power transmission member 25 is interposed between the roller 20 and the rotation shaft 30 in the hollow of the roller 20 such that the roller 20 smoothly rotates.

The hydraulic pressure supply portion 40 supplies hydraulic pressure to inside of the lever body 10 through the connecting hole 14. In addition, the hydraulic pressure supply portion 40 may be a general hydraulic lash adjuster (HLA) which supplies hydraulic pressure so as to operate a variable valve lift apparatus. Herein, the hydraulic lash adjuster is a device for supplying the hydraulic pressure to operate the variable valve lift apparatus as well as making a valve lifter to move in close contact with the cam always, of which detailed description will be omitted as the device is well known to a person of an ordinary skill in the art.

The hydraulic pressure supply portion 40 forms a hydraulic pressure supply hole 42.

The hydraulic pressure supply hole 42 is a hole which is formed at a portion that the hydraulic pressure supply portion 40 is contacted to the seating groove 12 such that hydraulic pressure generated from the hydraulic pressure supply portion 40 is supplied to the lever body 10. In addition, hydraulic pressure generated from the hydraulic pressure supply portion 40 is supplied to the lever body 10 through the connecting hole 14 as the hydraulic pressure supply hole 42 is communicated with the connecting hole 14 which is communicated with the seating groove 12.

Figure 2:
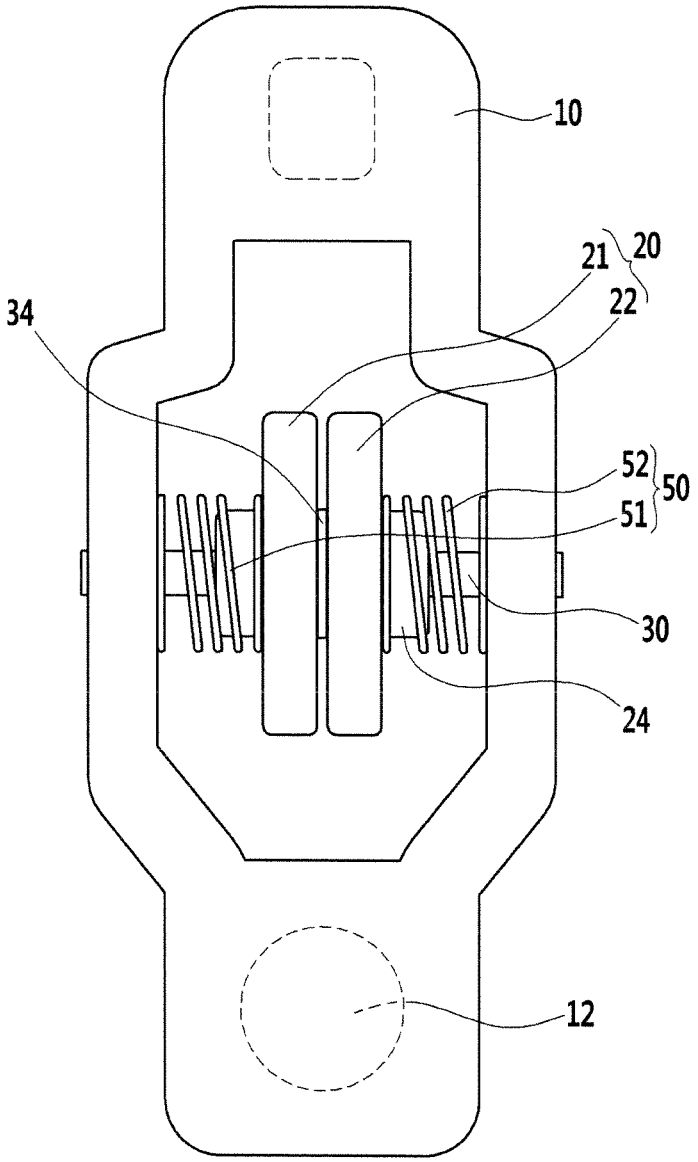
FIG. 2 is a top plan view of a variable valve lift apparatus according to an exemplary embodiment of the present inventive concept.
Figure 3:
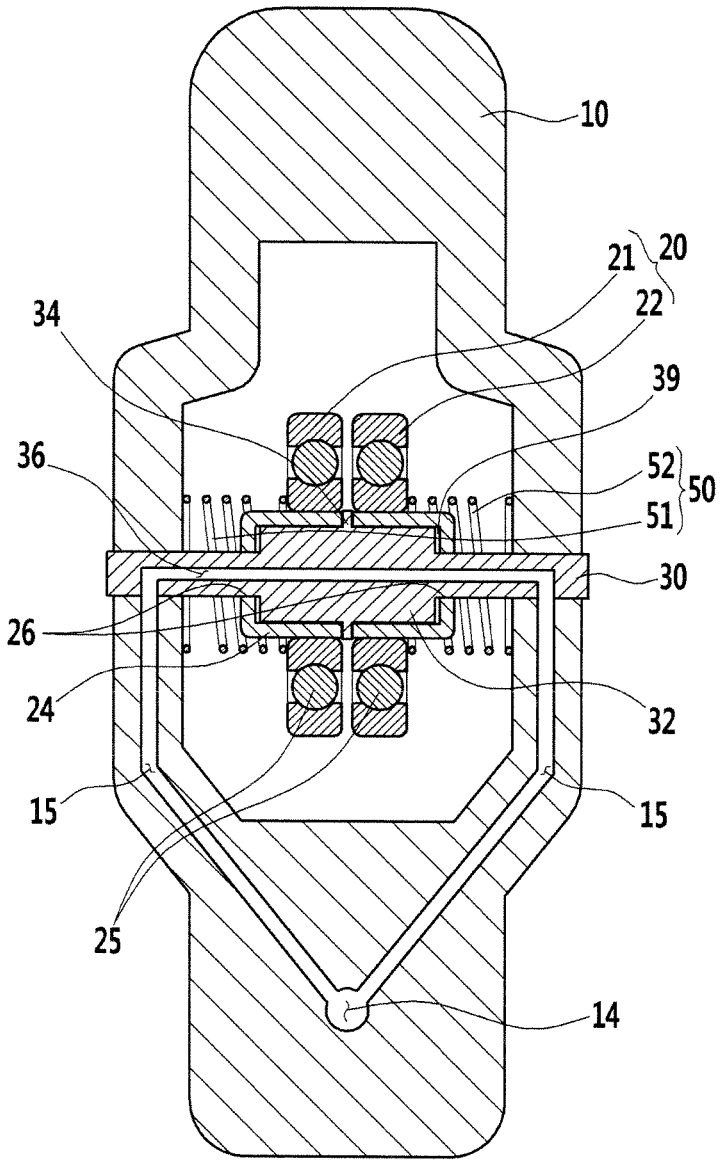
FIG. 3 is a cross-sectional view to illustrate a state that a variable valve lift apparatus according to an exemplary embodiment of the present inventive concept realizes a low lift of a valve.

FIG. 2 is a top plan view of a variable valve lift apparatus according to an exemplary embodiment of the present inventive concept, and FIG. 3 is a cross-sectional view to illustrate a state that a variable valve lift apparatus according to an exemplary embodiment of the present inventive concept realizes a low lift of a valve.

As shown in FIG. 2 and FIG. 3, a variable valve lift apparatus according to an exemplary embodiment of the present inventive concept further includes a housing 24, a penetrating hole 26, a shaft body 32, a stopper 34, a shaft oil passage 36, a body oil passage 15, and an elastic member 50.

The housing 24 may function as an inner race of a rolling bearing which is comprised with the roller 20, the power transmission member 25, and the housing 24 between the power transmission member 25 and the rotation shaft 30. Herein, the function of the inner race of the rolling bearing is well known to a person of an ordinary skill in the art, so a detailed description thereof will be omitted.

The housing 24 is formed in a cup shape that a cross section thereof has a shape. At this time, the roller 20 is comprised by two rollers 21 and 22 which are disposed such that interior surfaces face each other, and the two rollers 21 and 22 will be called "first roller 21" and "second roller 22" for better comprehension and convenience of description. In addition, the housing 24 is respectively protruded from exterior surfaces of the first roller 21 and the second roller 22 so as to form a cup shape. That is, the opened side of the 'U' shape cross section of the housing 24 is respectively disposed toward interior surfaces of the first roller 21 and the second roller 22, the closed side thereof is respectively disposed toward exterior surfaces of the first roller 21 and the second roller 22 or is respectively protruded to pass the exterior surfaces.

The penetrating hole 26 is formed at the closed side of the housing 24. In addition, the rotation shaft 30 is inserted into the penetrating hole 26 so as to penetrate the housing 24.

The shaft body 32 is formed at a center portion in a length direction of the rotation shaft 30 to be thicker than both ends in the length direction of the rotation shaft 30. That is, the shaft body 32 is formed to be stepped with the rotation shaft 30.

The shaft body 32 is disposed inside of the cup shape of the housing 24. In addition, an exterior circumference of the shaft body 32 has a size corresponding with an interior circumference of the housing 24, and air-tightness is ensured between the exterior circumference of the shaft body 32 and the interior circumference of the housing 24. Further, the housing 24 is guided by the shaft body 32 and is provided so as to be able to slide together with the roller 20 along the length direction of the rotation shaft 30.

The stopper 34 is formed by protruding from the exterior circumference of the shaft body 32 at a center portion in a length direction of the shaft body 32. In addition, the stopper 34 is disposed between the first roller 21 and the second roller 22. Further, the stopper 34 limits that the first roller 21 and the second roller 22 are excessively moved toward an inside direction in the motion of the first roller 21 and the second roller 22 sliding along a length direction of the rotation shaft 30 and prevents that interior surfaces of the first roller 21 and the second roller 22 are impacted or contacted with each other.

The shaft oil passage 36 is an oil passage which is formed to traverse the shaft body 32 along the length direction in the rotation shaft 30.

The body oil passage 15 is an oil passage which is formed or disposed at the lever body 10 and is disposed so as to communicate the connecting hole 14 and the shaft oil passage 36.

The elastic member 50 is disposed between an interior surface of the interior space of the lever body 10 and an exterior surface of the roller 20. In addition, the elastic member 50 functions to push the roller 20 toward inside.

In case that the first roller 21 and the second roller 22 are provided, the elastic member 50 is respectively disposed between an exterior surface of the first roller 21 and an interior surface to face the exterior surface of the first roller 21 in the interior space of the lever body 10 and between an exterior surface of the second roller 22 and an interior surface to face the exterior surface of the second roller 22 in the interior space of the lever body 10. For better comprehension and convenience of description, an elastic member 50 which functions to push the first roller 21 will be called "first elastic member 51", and an elastic member 50 which functions to push the second roller 22 will be called "second elastic member 52." In addition, outside of the elastic member 50 is supported to an interior surface of the interior space of the lever body 10, and inside thereof is supported to an exterior surface of the roller 20. Further, the elastic member 50 may be a coil spring, and the protruded portion of the housing 24 may be inserted inside of the coil spring such that the inside of the coil spring is seated with surrounding the protruded portion of the housing 24.

Figure 4:
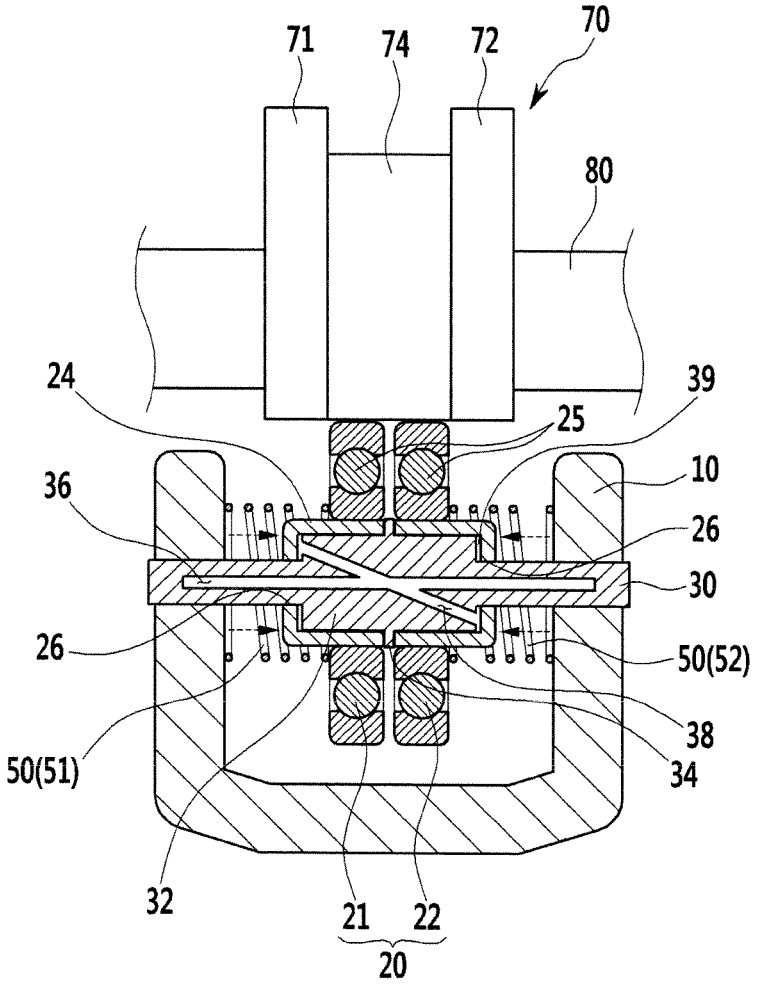
FIG. 4 illustrates an operation diagram of a variable valve lift apparatus according to an exemplary embodiment of the present inventive concept for realizing a low lift of a valve.

FIG. 4 illustrates operation diagrams of a variable valve lift apparatus according to an exemplary embodiment of the present inventive concept for realizing a low lift of a valve.

As shown in FIG. 4, a variable valve lift apparatus according to an exemplary embodiment of the present inventive concept further includes a high cam 71 and 72, a low cam 74, a hydraulic pressure chamber 39, and a supply passage 38. That is, the cam 70 is comprised with the high cam 71 and 72 and the low cam 74.

The high cam 71 and 72 is a cam which rotates for realizing a high lift of the valve 60, and is formed or disposed so as to protrude from an exterior circumference of the camshaft 80.

The low cam 74 is a cam which rotates for realizing a low lift of the valve 60, and is formed or disposed so as to protrude from an exterior circumference of the camshaft 80.

Figure 6:
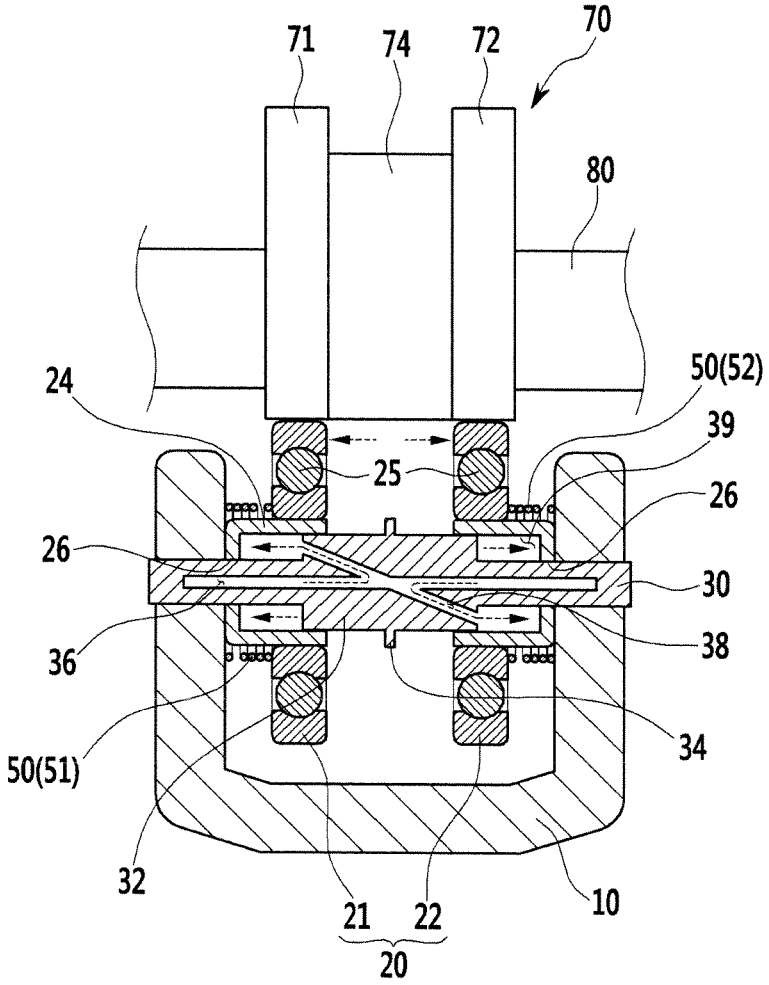
FIG. 6 illustrates an operation diagram of a variable valve lift apparatus according to an exemplary embodiment of the present inventive concept for realizing a high lift of a valve.

The high cam 71 and 72 is formed such that a lobe thereof protrudes further than a lobe of the low cam 74. In addition, the high cam 71 and 72 and the low cam 74 are formed such that bases thereof are equal to each other. FIG. 4 and FIG. 6 show that two high cams 71 and 72 are respectively disposed at both sides of the low cam 74, but it is not limited thereto, and positions of the high cam 71 and 72 and the low cam 74 may be opposite according to a design of a person skilled in the art.

In case that the two high cams 71 and 72 are respectively disposed at both sides of the low cam 74, a high cam 71 and 72 which is contacted with the first roller 21 by operation of a variable valve lift apparatus according to an exemplary embodiment of the present inventive concept will be called "first high cam 71", and a high cam 71 and 72 which is contacted with the second roller 22 by that will be called "second high cam 72" for better comprehension and convenience of description.

The hydraulic pressure chamber 39 is space which is formed between the exterior surface of the shaft body 32 and the closed side interior surface of the housing 24 which are formed by the step of the shaft body 32 and the rotation shaft 30.

The supply passage 38 is formed in the shaft body 32 and is disposed to be slanted with respect to a length direction of the rotation shaft 30 so as to be crossed with the shaft oil passage 36. In addition, the supply passage 38 is extended to the exterior surface of the shaft body 32 so as to be communicated with the hydraulic pressure chamber 39.

As shown in FIG. 2 to FIG. 4, the case that hydraulic pressure is not supplied from the hydraulic pressure supply portion 40 into the lever body 10 will be described.

The first roller 21 and the second roller 22 are respectively pushed toward inside by the first elastic member 51 and second elastic member 52. The first roller 21 and the second roller 22 rolling-contacts with the low cam 74 on a state that the interior surface of the first roller 21 and the second roller 22 or the interior surface of the housing 24 is contacted with the stopper 34. On this state, the low lift of the valve 60 is realized according to the camshaft 80 and the cam 70 rotate. FIG. 4 shows a moving direction of the roller 20 which is moved by the elastic member 50 by dotted line arrows.

Figure 5:
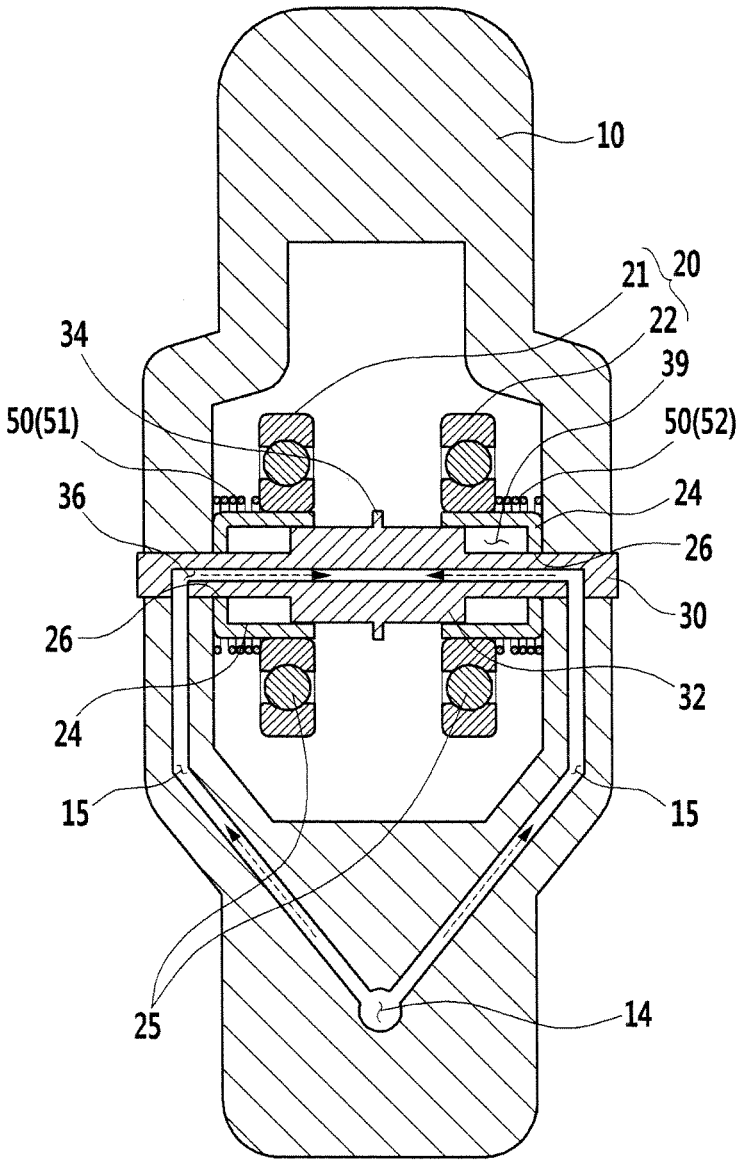
FIG. 5 is a cross-sectional view to illustrate a state that a variable valve lift apparatus according to an exemplary embodiment of the present inventive concept realizes a high lift of a valve.

FIG. 5 is a cross-sectional view to illustrate a state that a variable valve lift apparatus according to an exemplary embodiment of the present inventive concept realizes a high lift of a valve, and FIG. 6 illustrate operation diagrams of a variable valve lift apparatus according to an exemplary embodiment of the present inventive concept for realizing a high lift of a valve.

As shown in FIG. 5 and FIG. 6, the case that hydraulic pressure is supplied from the hydraulic pressure supply portion 40 into the lever body 10 will be described.

Hydraulic pressure generated from the hydraulic pressure supply portion 40 is supplied to the hydraulic pressure chamber 39 via sequentially the hydraulic pressure supply hole 42, the connecting hole 14, the body oil passage 15, the shaft oil passage 36, and the supply passage 38. FIG. 5 shows the route of supplying the hydraulic pressure by dotted line arrows.

The first roller 21 and the second roller 22 are slid toward outside when hydraulic pressure, which is stronger than the force that the elastic member 50 pushes the roller 20, is supplied to the hydraulic pressure chamber 39. Therefore, the first roller 21 rolling-contacts with the first high cam 71, and the second roller 22 rolling-contacts with the second high cam 72. On this state, the high lift of the valve 60 is realized according to the camshaft 80 and the cam 70 rotate. FIG. 6 shows a moving direction of the roller 20 which is moved by the hydraulic pressure supplied to the hydraulic pressure chamber 39 by dotted line arrows.

The first roller 21 and the second roller 22 are respectively returned by the first elastic member 51 and the second elastic member 52 if hydraulic pressure supply from the hydraulic pressure supply portion 40 is released (referring to FIG. 2 to FIG. 4). At this time, the stopper 34 functions so as to prevent the impact which may be generated by moving of the first roller 21 and the second roller 22 toward the inside direction as a latch protrusion which limits the motion that the first roller 21 and the second roller 22 are moved toward an inside direction.

The sliding motions of the first roller 21 and the second roller 22 according to supplying and releasing hydraulic pressure by the hydraulic pressure supply portion 40 are performed during a section that the roller 20 is contacted with the base of the cam 70. Therefore, the sliding motions of the first roller 21 and the second roller 22 are smoothly performed, and interference and impact which may be occurred during the sliding motions of the first roller 21 and the second roller 22 are prevented. A person of an ordinary skill in the art can easily realize the control of this operation by using a sensor and so on detecting the rotation phase of the camshaft 80 and the crankshaft (not shown).

Figure 7:
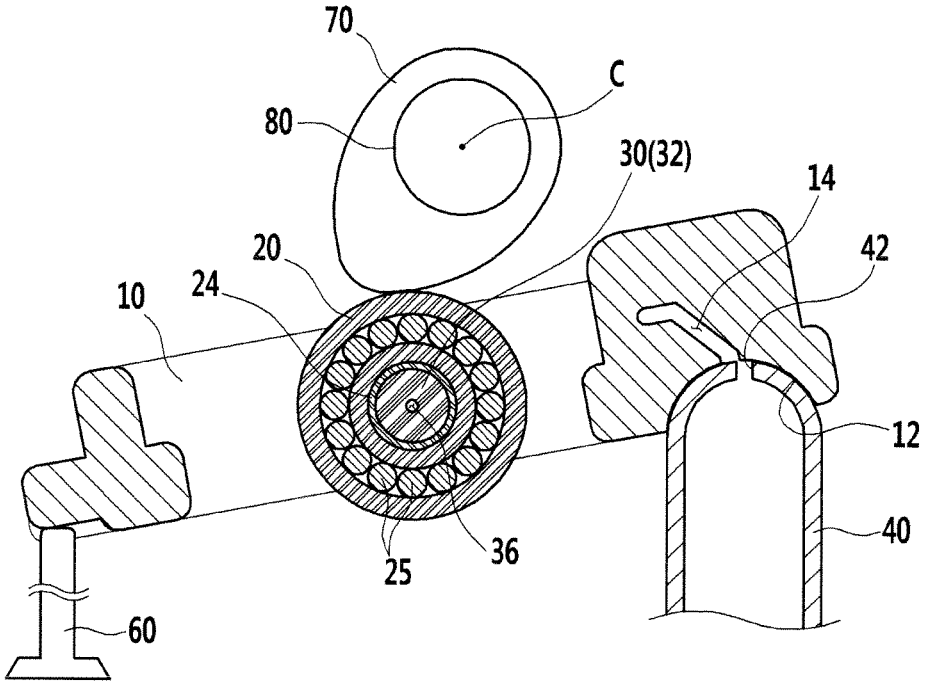
FIG. 7 illustrates an operation diagram of a variable valve lift apparatus according to an exemplary embodiment of the present inventive concept.

FIG. 7 illustrates operation diagrams of a variable valve lift apparatus according to an exemplary embodiment of the present inventive concept.

As shown in FIG. 7, the positions of the hydraulic pressure supply hole 42 of the hydraulic pressure supply portion 40 and the connecting hole 14 of the lever body 10 are not equal to each other during a section such that the roller 20 contacts the lobe of the cam 70. Therefore, the communication of the hydraulic pressure supply hole 42 and the connecting hole 14 are closed, and hydraulic pressure is not supplied into the lever body 10 by the hydraulic pressure supply portion 40. At this time, hydraulic pressure supplied into the lever body 10 is naturally maintained.

The malfunction of the variable valve lift apparatus by changing pressure of an oil control valve (OCV, not shown) is prevented by this operation. In addition, it is prevented in advance that supplying and releasing hydraulic pressure are performed during the section that the roller 20 is contacted with the lobe of the cam 70.

The valve 60 is driven by low lift in the condition such as the malfunction of oil control valve or the stop of a engine as the roller 20 is moved so as to be contacted with the low cam 74 by the elastic member 50 when the hydraulic pressure is released according to an exemplary embodiment of the present inventive concept.

According to an exemplary embodiment of the present inventive concept, it can be prevented that the fuel consumption is deteriorated by interference and friction between constituent elements as the roller 20 is selectively contacted with the high cam 71 and 72 or the low cam 74, and only the roller 20 contacts the high cam 71 and 72 or the low cam 74. In addition, reactivity may be improved and cost may be reduced as the composition for that the roller 20 is selectively contacted with the high cam 71 and 72 or the low cam 74 is to be simple by using hydraulic pressure. Further, the fuel consumption may be ultimately improved as a suitable valve lift is realized according to rotational speed and load of the engine.

While this inventive concept has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve lift apparatus for selectively changing a lift of a valve to perform intake or exhaust of an engine according to rotation of a camshaft with a high lift or a low lift, the variable valve lift apparatus comprising:

a lever body having a set length for a lever motion according to the rotation of the camshaft and adapted that one end thereof is connected with a hydraulic pressure supply portion and another end thereof is connected with the valve;

a rotation shaft disposed such that a width direction of the lever body is a length direction of the rotation shaft;

a roller disposed to rotate around the rotation shaft;

a high cam disposed at the camshaft to rotate together with the camshaft and to have a lobe shape, the high cam rolling-contacted with the roller to realize the high lift; and a low cam disposed at the camshaft to rotate together with the camshaft and have a lobe shape, the low cam rolling-contacted with the roller to realize the low lift, wherein the roller is disposed to slide along the length direction of the rotation shaft and is selectively rolling-contacted with the high cam or the low cam by sliding.

2. The variable valve lift apparatus of claim 1, wherein a housing, which has a cup shape such that an inner side thereof is opened and an outer side thereof is closed, is formed at the roller, a shaft body which is disposed inside of the housing and is adapted to be thicker than both ends of the length direction of the rotation shaft is formed at the rotation shaft, and both ends of the length direction of the rotation shaft are disposed to respectively penetrate the closed outer side of the housing.

3. The variable valve lift apparatus of claim 2, further comprising:

an elastic member supported by the lever body to push an exterior surface of the roller toward inside, wherein a hydraulic pressure chamber is formed between an interior surface of the close outer side of the housing and an exterior surface of the shaft body.

4. The variable valve lift apparatus of claim 3, wherein the roller is slid by a hydraulic pressure supplied from the hydraulic pressure supply portion to the hydraulic pressure chamber, and the roller is slid toward inside by the elastic member as the hydraulic pressure supplied from the hydraulic pressure supply portion to the hydraulic pressure chamber is released.

5. The variable valve lift apparatus of claim 4, wherein the lever body forms a connecting hole which receives the hydraulic pressure from the hydraulic pressure supply portion and a body oil passage which is communicated with the connecting hole and extends toward the rotation shaft, and the rotation shaft forms a shaft oil passage which communicates with the body oil passage inside of the rotation shaft and a supply passage which is disposed to be crossed with the shaft oil passage and communicates with the hydraulic pressure chamber.

6. The variable valve lift apparatus of claim 5, wherein the hydraulic pressure generated from the hydraulic pressure supply portion sequentially passes through the connecting hole, the body oil passage, the shaft oil passage, and the supply passage to be supplied to the hydraulic pressure chamber.

7. The variable valve lift apparatus of claim 5, wherein the shaft oil passage is formed with traversing the shaft body along the length direction of the rotation shaft, and the supply passage is formed to slant with respect to the length direction of the rotation shaft to extend to the exterior surface of the shaft body and communicate with the hydraulic pressure chamber.

8. The variable valve lift apparatus of claim 4, wherein a stopper which functions as a blocker to limit sliding of the roller when the roller slides toward inside by releasing hydraulic pressure supply is formed to protrude from an exterior circumference of the shaft body.

9. The variable valve lift apparatus of claim 4, wherein the roller is slid toward outside to rolling-contact the high cam and slides toward inside to rolling-contact the low cam.

10. The variable valve lift apparatus of claim 4, wherein the roller has two rollers and the two rollers simultaneously slide toward outside or slid toward inside.

11. The variable valve lift apparatus of claim 10, wherein the high cam has two high cams which are disposed at both sides of the low cam, and the two rollers slide toward outside to respectively rolling-contact to the high cams which are respectively disposed at the both sides of the low cam and are slid toward inside to rolling-contact the low cam.

12. A variable valve lift apparatus comprising:

a lever body having a set length for a lever motion according to rotation of a camshaft and having a set width and a set thickness to form an interior space which is vertically penetrated thereto;

a hydraulic pressure supply portion mounted at one end of the lever body to supply hydraulic pressure to the lever body;

a rotation shaft disposed to traverse the interior space of the lever body;

a roller disposed in the interior space of the lever body, the roller rotating around the rotation shaft and sliding along a length direction of the rotation shaft;

a shaft body being thicker than both ends of the length direction of the rotation shaft at a middle portion in the length direction of the rotation shaft to contact an interior circumference of the roller for guiding the roller which slides;

a hydraulic pressure chamber formed between an exterior surface of the shaft body and an exterior surface of the roller;

an elastic member disposed between an interior surface of the lever body surrounding the interior space and the exterior surface of the roller;

a high cam selectively rolling-contacting the roller and rotating together with the camshaft to make a lever motion of the lever body and having a lobe shape for realizing a high lift of a valve which is connected with the one end of the lever body; and a low cam selectively rolling-contacting the roller and rotating together with the camshaft for a lever motion of the lever body, and having a lobe shape for realizing a low lift of the valve which is connected with the one end of the lever body, wherein the roller slides toward outside to rolling-contact the high cam according to a hydraulic pressure is supplied from the hydraulic pressure supply portion to the hydraulic pressure chamber, and the roller slides toward inside by the elastic member to rolling-contact the low cam when the hydraulic pressure of the hydraulic pressure chamber is released.

13. The variable valve lift apparatus of claim 12, further comprising:

a connecting hole formed at the one end of the lever body to receive the hydraulic pressure from the hydraulic pressure supply portion;

a body oil passage formed in the lever body to communicate with the connecting hole and be extended toward the rotation shaft;

a shaft oil passage formed in the rotation shaft to communicate with the body oil passage; and a supply passage formed at the shaft body to be crossed with the shaft oil passage and be communicated with the hydraulic pressure chamber.

14. The variable valve lift apparatus of claim 13, wherein hydraulic pressure generated from the hydraulic pressure supply portion sequentially passes through the connecting hole, the body oil passage, the shaft oil passage, and the supply passage to be supplied to the hydraulic pressure chamber.

15. The variable valve lift apparatus of claim 13, wherein a hydraulic pressure supply hole which communicates with the connecting hole is formed at the hydraulic pressure supply portion such that the hydraulic pressure generated from the hydraulic pressure supply portion is supplied to the lever body, and the connecting hole communicates with the hydraulic pressure supply hole when the roller contacts a base of the high cam or the low cam and the communication between the connecting hole and the hydraulic pressure supply hole is closed when the roller is contacted to a lobe of the high cam or the low cam.

16. The variable valve lift apparatus of claim 13, wherein the supply passage is formed to slant with respect to the length direction of the rotation shaft.

17. The variable valve lift apparatus of claim 12, wherein a base of the high cam conforms to a base of the low cam.

18. The variable valve lift apparatus of claim 12, wherein a stopper which protrudes from an exterior circumference of the shaft body is formed to limit sliding of the roller when the roller is slid toward inside.

19. The variable valve lift apparatus of claim 12, wherein the roller has two rollers which simultaneously slide toward outside or slide toward inside.

20. The variable valve lift apparatus of claim 19, wherein the high cam has two high cams which are disposed at both sides of the low cam such that the two rollers slide toward outside to respectively rolling-contact the two high cams.

* * * * *